US008447058B1

(12) United States Patent
Sung et al.

(10) Patent No.: US 8,447,058 B1
(45) Date of Patent: May 21, 2013

(54) HEADPHONE WITH ACOUSTIC MODULATOR

(75) Inventors: Po-Hsun Sung, Taichung (TW); Chun-Fu Wang, Taichung (TW); Hung-Wen Tsao, Taichung (TW)

(73) Assignee: Merry Electronics Co., Ltd., Taichung (TW)

( * ) Notice: Subject to any disclaimer, the term of this patent is extended or adjusted under 35 U.S.C. 154(b) by 17 days.

(21) Appl. No.: 13/309,639

(22) Filed: Dec. 2, 2011

(51) Int. Cl.
*H04R 25/00* (2006.01)

(52) U.S. Cl.
USPC ..... 381/373; 381/370; 381/371

(58) Field of Classification Search
USPC ..... 381/370–374, 378, 380–381
See application file for complete search history.

(56) References Cited

U.S. PATENT DOCUMENTS

| | | | | |
|---|---|---|---|---|
| 4,239,945 | A * | 12/1980 | Atoji et al. | 381/371 |
| 5,844,998 | A * | 12/1998 | Nageno | 381/371 |
| 6,934,401 | B2 * | 8/2005 | Grell et al. | 381/371 |
| 7,916,888 | B2 * | 3/2011 | Sapiejewski et al. | 381/370 |

* cited by examiner

*Primary Examiner* — Suhan Ni
(74) *Attorney, Agent, or Firm* — WPAT, PC; Justin King

(57) ABSTRACT

A headphone having a headband and two acoustic transducers disposed at two ends of the headband is disclosed. Each acoustic transducer includes a baffle plate installed with a speaker, a spacer, a vent and an acoustic modulator. The baffle plate and speaker divide the acoustic transducer into a front and a back chamber. The front chamber is configured for communicating with a user's ear. The spacer is disposed behind the speaker to divide the back chamber into a first back chamber and a second back communicated with each other. The vent is disposed in a back wall of the acoustic transducer to communicate the first back chamber with outside. The first acoustic modulator is disposed between the front and second back chambers. The headphone modulates resonance frequency at low frequency bands through the acoustic modulator.

11 Claims, 6 Drawing Sheets

HEADPHONE WITH ACOUSTIC MODULATOR

TECHNICAL FIELD

The present inventions relates to a headphone, and more particularly to a headphone that includes an acoustic modulator for modulating the sound in low frequency bands thereby improving frequency response of the headphone.

BACKGROUND

As a result of continuous advance of technology, evolution of various electronic devices also becomes more and more quickly. Generally, headphones are used as voice transmitting tools between electronic devices and user's ears. Except wearing conformability, voice quality is also a more important consideration during the development of headphones.

FIG. 1 is a schematic cross-sectional view of a conventional headphone, which primarily includes a shell cover 1 and a shell body 2. A chamber space 3 defined between the shell cover 1 and the shell body 2 receives a circuit board 4 and a speaker 5 therein. The shape and/or structure of the circuit board 4 are constructed to be tightly mated with an inner ring-shaped contour of the shell cover 1. The speaker 5 is electrically connected to the circuit board 4 and outputs digital audio signals from a media player (not shown). The outer face of the shell body 2 is covered by an ear cover 6. The ear cover 6 provides user a great contact feeling while the headphone is tightly contacted with user's ears. In addition, the ear cover 6 also makes the headphone able to closely contact with user's auricles so as to prevent the ambient noise from leaking into the user's ears.

The aforementioned headphone has a passive de-noising ability provided by the ear covers 6; however, the speaker 5 is divided into a front chamber and a rear chamber. The front chamber and the ear cover 6 are connected to the users' auditory meatus, and the rear chamber is connected to the back of the speaker 5. In addition, the inner structure configuration of the aforementioned headphone should be designed to obtain improved sound quality at low frequency bands. However, to achieve better sound quality at low frequency bands, the headphone of special structure needs to overcome some space structure limits.

SUMMARY OF EMBODIMENTS

Therefore, the object of the present invention is to provide a headphone capable of modulating the resonance frequency thereof at the low frequency.

An embodiment of the present invention provides a headphone having a headband and two acoustic transducers disposed at two ends of the headband, respectively. Each acoustic transducer includes a baffle plate installed with a speaker, a spacer, a vent and an acoustic modulator. The baffle plate and speaker cooperatively divide the acoustic transducer into a front chamber and a back chamber. The front chamber is configured for communicating with a user's ear canal while the user put on the headphone. The spacer is disposed behind the speaker to divide the back chamber into a first back chamber and a second back chamber communicated with each other. The vent is disposed in a back wall of the acoustic transducer to communicate the first back chamber with an outside environment. The first acoustic modulator is disposed between the front chamber and the second back chamber. The acoustic modulator modulates a resonance frequency of the headphone at low frequency bands In the above embodiment, the acoustic modulator includes a low frequency tube and an acoustic damper. The low frequency tube, disposed between the front chamber and the second back chamber, and the acoustic damper, disposed in the front chamber to enclose one end of the low frequency tube, are used for improving the frequency response curve.

In another embodiment, one end of the low frequency tube extends into the front chamber and another end is coplanar with a surface of the back wall of the baffle plate instead of extending into the second back chamber, so that the acoustic modulator in the present embodiment is suitable for a headphone requiring some different acoustic characteristics.

In still another embodiment, the headphone includes two acoustic modulators disposed at two opposite sides of the speaker and for modulating different low-frequency curves.

BRIEF DESCRIPTION OF THE DRAWINGS

The above embodiments will become more readily apparent to those ordinarily skilled in the art after reviewing the following detailed description and accompanying drawings, in which.

DETAILED DESCRIPTION OF PREFERRED EMBODIMENTS

The disclosure will now be described more specifically with reference to the following embodiments. It is to be noted that the following descriptions of preferred embodiments are presented herein for purpose of illustration and description only. It is not intended to be exhaustive or to be limited to the precise form disclosed.

Figure 1:
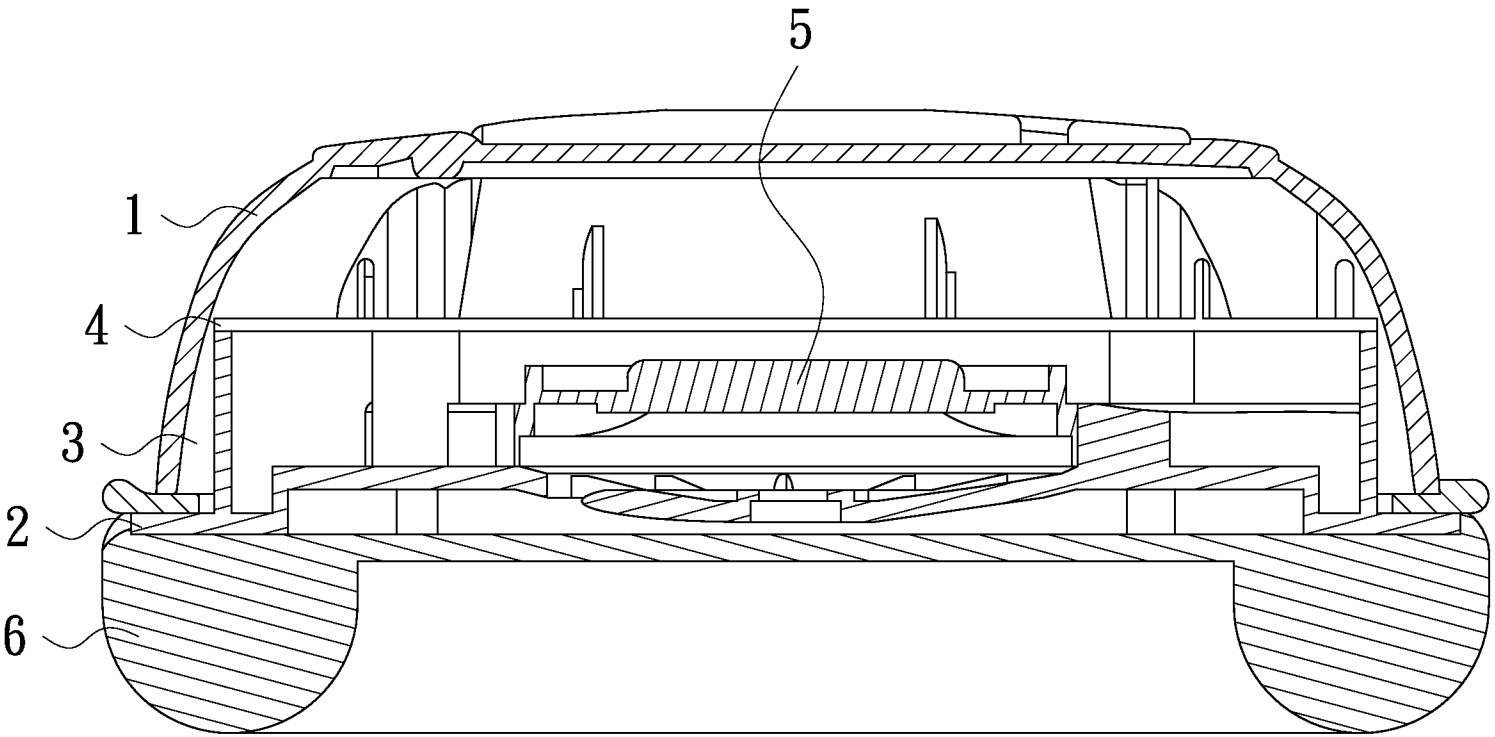
FIG. 1 (Prior Art)
FIG. 1 is a schematic view of a conventional headphone.
Figure 2:
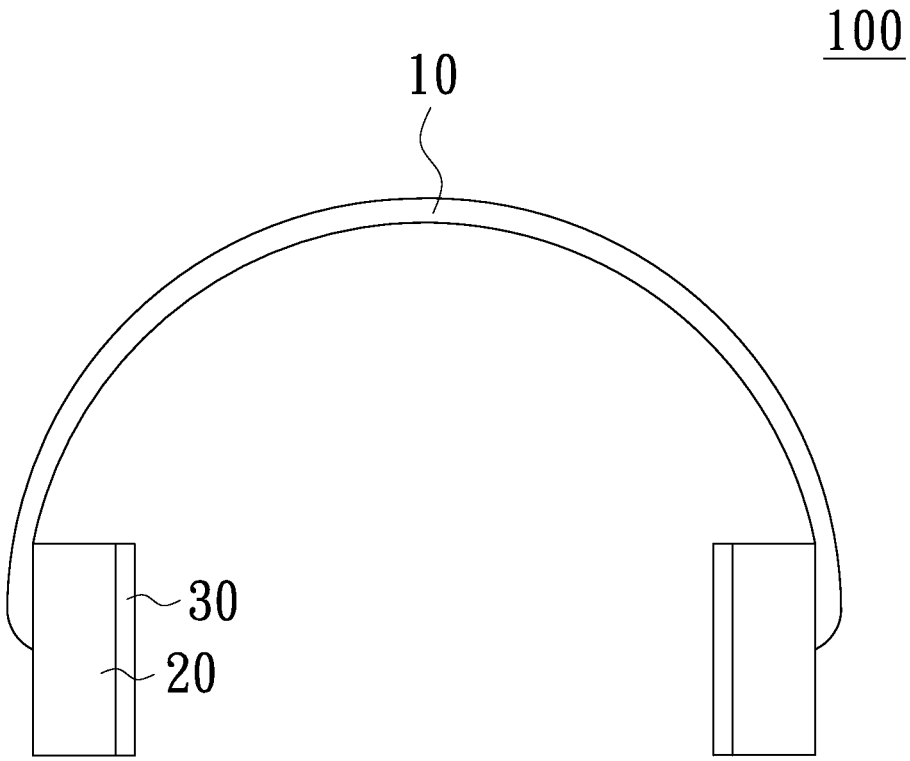
FIG. 2 is a schematic view of a headphone having an acoustic modulator in accordance with a first embodiment of the present invention.

FIG. 2 is a schematic view of a headphone having an acoustic modulator in accordance with an embodiment of the present invention. As shown in FIG. 2, the headphone 100 includes a headband 10, a pair of acoustic transducers 20 and a pair of ear covers 30. The two acoustic transducers 20 are disposed at two ends of the headband 10, respectively; and each of the pair of ear covers 30 is attached to a front end of a respective acoustic transducer 20.

Figure 3:
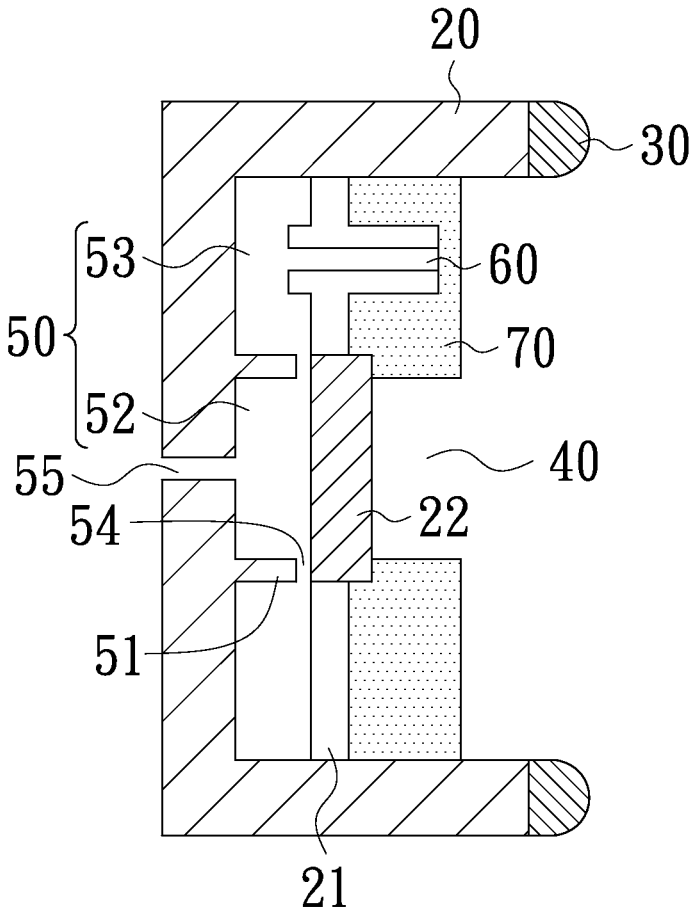
FIG. 3 is a schematic cross-sectional view of an acoustic transducer used in the headphone of the first embodiment.

FIG. 3 is a schematic cross-sectional view of the acoustic transducer 20. The acoustic transducer 20 has a shell structure, which can be a one-piece structure or constructed by more than one component. A baffle plate 21 is disposed in a space defined by an inside of the acoustic transducer 20. A speaker 22 is installed in a central region of the baffle plate 21, and the baffle plate 21 and the speaker 22 cooperatively divide the space inside the acoustic transducer 20 into a front chamber 40 and a back chamber 50. The ear cover 30 is comprised of cushioning material, and thus provides comfortable feel and less leakage of voice and isolates a user's ear from the exterior sounds when a user wears the headphone 100. After the user put on the headphone 100, an enclosed space, in other words the front chamber 40, is formed between the speaker 22 and the user's ear. Besides, it is to be noted that the position of the speaker 22 in the baffle plate 21 can also be offset from the center according to the user's ear.

A ring-shaped spacer 51 is disposed on the back wall (i.e., the wall near to the speaker 22) of the acoustic transducer 20. The spacer 51 divides the back chamber 50 into a circular first back chamber 52 and an annular second back chamber 53, and the first back chamber 52 is surrounded by the second back chamber 53. For example, the first back chamber 52 is concentric with the second back chamber 52. In addition, a gap 54 is formed between an end of the spacer 51 (i.e., the end that is proximal to the speaker 22) and the baffle plate 21. The gap 54 functions like a path, and through the path the first back chamber 52 is in communication with the second back chamber 53.

A vent 55 is formed in the back wall of the acoustic transducer 20, and through the vent 55 the first back chamber 52 is in communication with an outside environment. It is to be noted that the number of the vent 55 is not limited to one; in other words, the acoustic transducer 20 may include more than one vent 55 if the headphone 100 is required to have some specific acoustic characteristics.

In addition, an acoustic modulator is disposed in the acoustic transducer 20 between the front chamber 40 and the second back chamber 53. The acoustic modulator includes a low frequency tube 60 and an acoustic damper 70. The low frequency tube 60 is configured to be perpendicular to and penetrating through the baffle plate 21; that is, the low frequency tube 60 is connected between the front chamber 40 and the second back chamber 53, and accordingly two ends of the low frequency tube 60 are communicated with the front chamber 40 and the second back chamber 53, respectively. The low frequency tube 60 has a predetermined length. One end of the low frequency tube 60 is inserted into the acoustic damper 70 and the other end of the low frequency tube 60 is inserted into the second back chamber 53. The low frequency tube 60 is configured for adjusting resonance frequency at low frequency bands. Besides, the acoustic damper 70 is disposed in the front chamber 40, and specifically, one end of the low frequency tube 60 in the front chamber 53 is enclosed or wrapped by the acoustic damper 70. The acoustic damper 70 is configured for adjusting the resonance quality factor (Q value) at the low frequency bands. Consequently, the frequency response curve of the headphone 100 is modulated. In addition, because the front chamber 40 is in communication with the second back chamber 53 through the low frequency tube 60, the ear pressure in the front chamber 40 and the second back chamber 53 can be released in a uniform manner and the response to the specific low frequency band can also be amplified. As such, the headphone 100 can achieve excellent anti-noising effect if used together with an active de-noising circuit.

Figure 4:
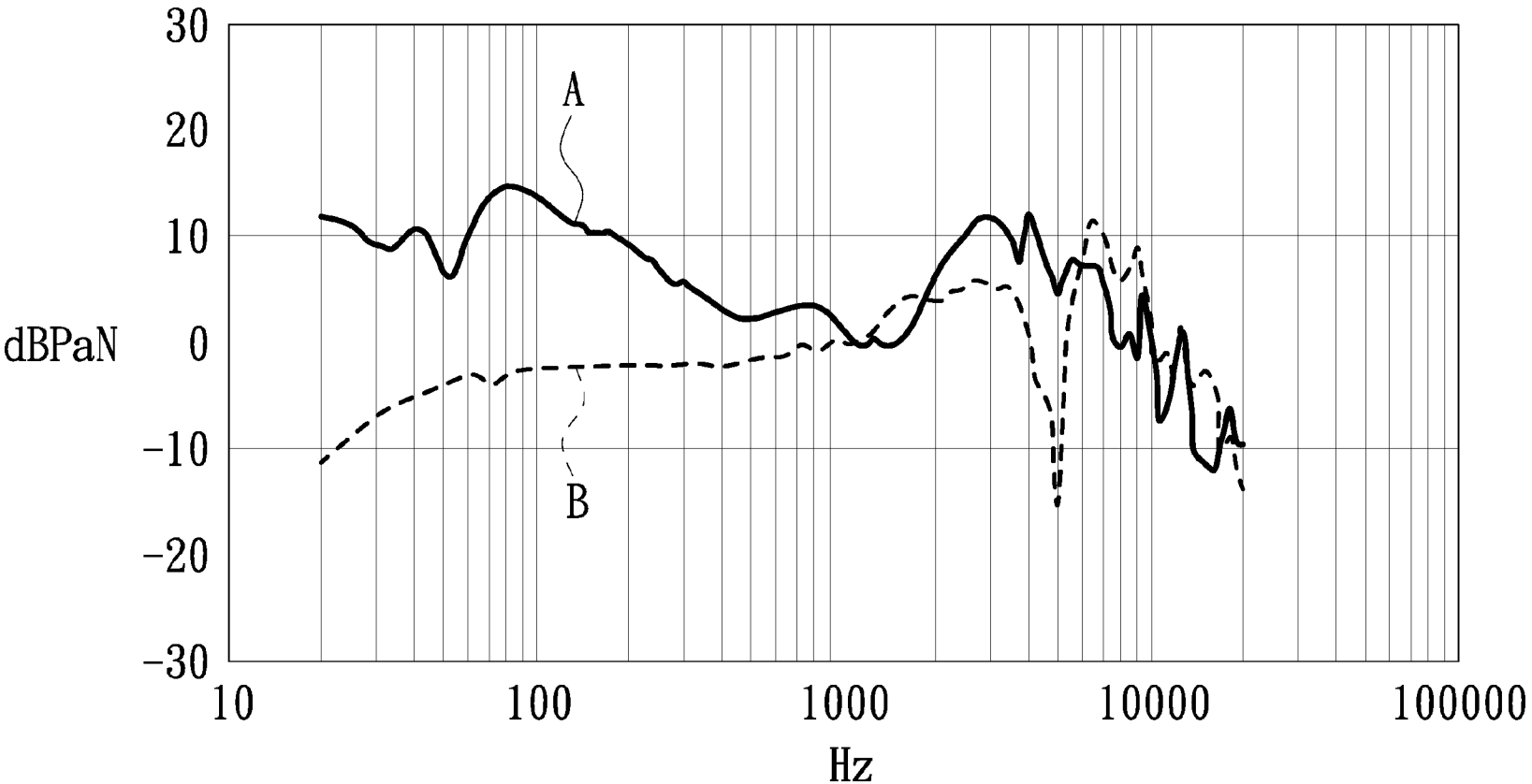
FIG. 4 is a schematic view illustrating two acoustic curves of the acoustic transducer of the first embodiment and the conventional acoustic transducer, respectively.

FIG. 4 is a schematic view illustrating two curves, wherein a curve A and a curve B represent acoustic characteristics of the headphone 100 and a conventional headphone, respectively. As shown in FIG. 4, compared with the curve B, the curve A has an improved amplifying effect in the low frequency bands.

Figure 5:
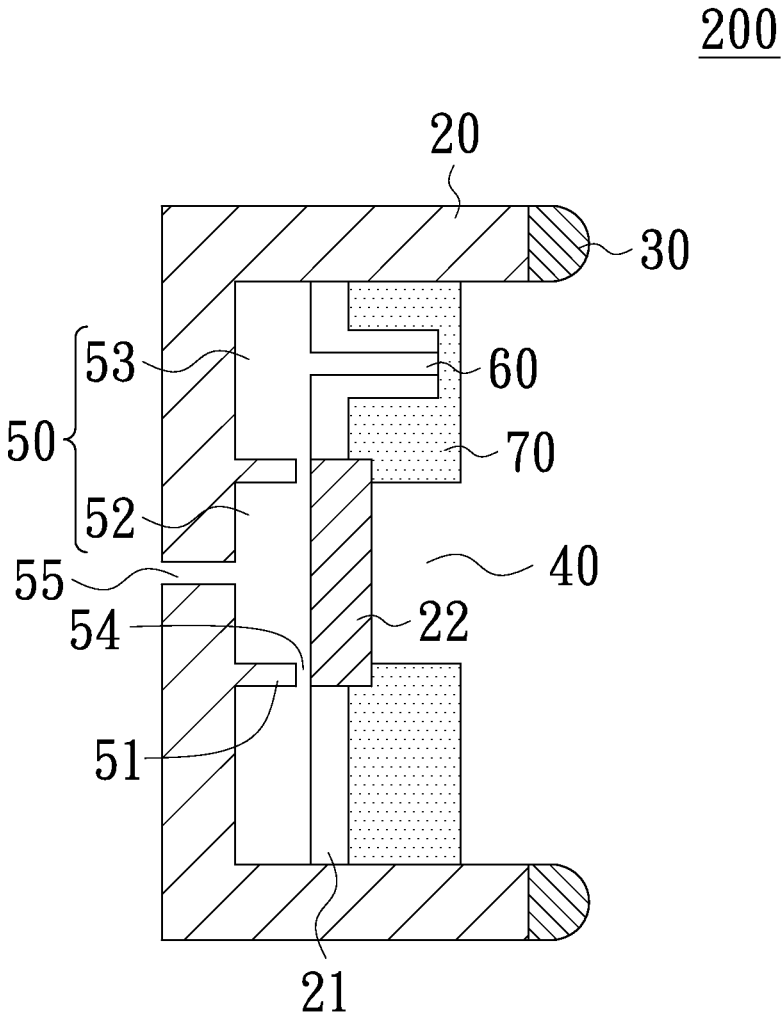
FIG. 5 is a schematic view of an acoustic transducer having an acoustic modulator in accordance with a second embodiment of the present invention.

FIG. 5 is a schematic cross-sectional view of an acoustic transducer 200 in accordance with a second embodiment of the present invention. The present embodiment is different with the aforementioned embodiment in the length of the low frequency tube 60. As illustrated in FIG. 5, the low frequency tube 60 in the second embodiment is relatively shorter, and one end thereof still extends into the acoustic damper 70 but another end thereof is coplanar with a surface of the back wall of the baffle plate 21 instead of extending into the inside of the second back chamber 53. As the shorter low frequency tube 60 is employed, the acoustic transducer 20 in the second embodiment has an acoustic curve that is different with that of the first embodiment. Thus, the low frequency tube of the present embodiment can be used in headphones of different acoustic performance.

Figure 6:
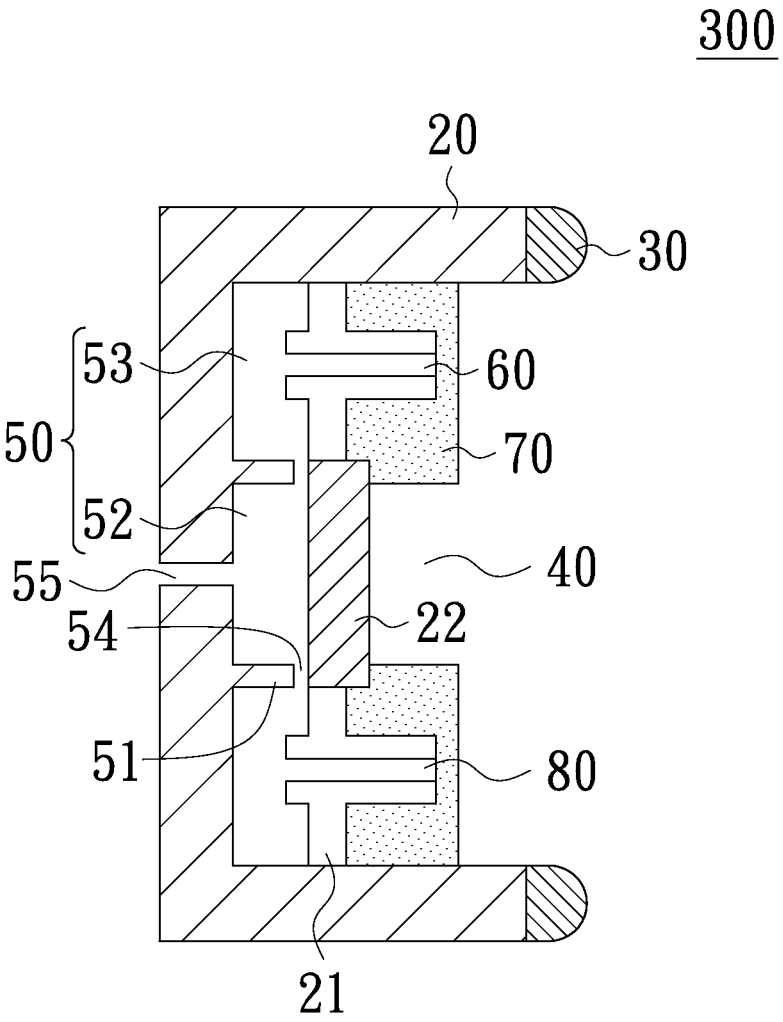
FIG. 6 is a schematic view of an acoustic transducer having an acoustic modulator in accordance with a third embodiment of the present invention.

FIG. 6 is a schematic cross-sectional view of an acoustic transducer 300 in accordance with a third embodiment of the present invention. The present embodiment is different with the aforementioned two embodiments in further including an additional low frequency tube 80 disposed at a side of the speaker 22. As shown in FIG. 6, the low frequency tubes 60, 80 are disposed at two opposite sides of the speaker 22, respectively. The two low frequency tubes 60, 80 of the present embodiment also facilitate modulating the resonance frequency at the low frequency bands more effectively.

To sum up, the above embodiments each disclose a headphone having an acoustic modulator. The headphone includes two transducers. The two transducers each include a front chamber, a back chamber and a low frequency tube. The first chamber is in communication with a user's canal. The back chamber is divided into a first back chamber and a second back chamber. The low frequency tube is between the front chamber and the second back chamber. An end of the low frequency tube in the front chamber is enclosed by an acoustic damper thereby adjusting resonance frequency of headphones at low frequency bands. An excellent ant-noising ability is further achieved if used together with an active de-noising circuit.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A headphone, comprising:

a headband and two acoustic transducers disposed at two ends of the headband, respectively;

each of the acoustic transducers comprising:

a baffle plate installed with a speaker, the baffle plate dividing an inside of the acoustic transducer into a front chamber and a back chamber, the front chamber being configured for communicating with a user's ear;

a spacer disposed behind the speaker to divide the back chamber into a first back chamber and a second back chamber communicated with each other;

a vent formed in a back wall of the acoustic transducer to communicate the first back chamber with an outside environment; and a first acoustic modulator disposed between the front chamber and the second back chamber for modulating a resonance frequency of the headphone at a low frequency.

2. The headphone according to claim 1, wherein the first acoustic modulator comprises a low frequency tube penetrating through the baffle plate, and two ends of the low frequency tube communicating with the front chamber and the second back chamber, respectively.

3. The headphone according to claim 2, wherein the first acoustic modulator further comprises an acoustic damper disposed in the front chamber to enclose one end of the low frequency tube.

4. The headphone according to claim 2, wherein two ends of the low frequency tube extend into an acoustic damper in the front chamber and the second back chamber, respectively.

5. The headphone according to claim 2, wherein one end of the low frequency tube extends into the front chamber and the other end of the low frequency tube is coplanar with a surface of a back wall of the baffle plate.

6. The headphone according to claim 1, wherein a gap is formed between the spacer and the baffle plate for communicating the first and second back chambers with each other.

7. The headphone according to claim 1, wherein the acoustic transducer further comprises a second acoustic modulator, and the first and second acoustic modulators are disposed at two opposite sides of the speaker, respectively.

8. The headphone according to claim 7, wherein the first and second acoustic modulators each comprise a low frequency tube disposed between the front and second back chambers.

9. The headphone according to claim 8, wherein the first and second acoustic modulators each further comprise an acoustic damper disposed in the front chamber to enclose one end of a corresponding low frequency tube.

10. The headphone according to claim 1, wherein the first back chamber is surrounded by the second back chamber.

11. The headphone according to claim 10, wherein the first back chamber is concentric with the second back chamber.

* * * * *